United States Patent [19]

Huggins

[11] Patent Number: 4,630,167

[45] Date of Patent: Dec. 16, 1986

[54] STATIC CHARGE NEUTRALIZING SYSTEM AND METHOD

[75] Inventor: Richard Huggins, Cupertino, Calif.

[73] Assignee: Cybergen Systems, Inc., Santa Clara, Calif.

[21] Appl. No.: 710,570

[22] Filed: Mar. 11, 1985

[51] Int. Cl.[4] ..... H05F 3/06

[52] U.S. Cl. ..... 361/213; 361/235; 361/231

[58] Field of Search ..... 361/212, 213, 229, 230, 361/231, 235

[56] References Cited

U.S. PATENT DOCUMENTS 2,264,495 2/1941 Wilner ..... 361/235 X 3,624,448 11/1971 Saurenman ..... 361/235 X 4,542,434 9/1985 Gehlke et al. ..... 361/213 X

*Primary Examiner*—L. T. Hix

*Assistant Examiner*—D. Rutledge

*Attorney, Agent, or Firm*—Flehr, Hohbach, Test, Albritton & Herbert

[57] ABSTRACT

A system and method for neutralizing a static charge using positive and negative ion discharge units. These units are operated alternately at a rate inversely proportional to the static voltage detected. The system and method operates the ion discharge units in a manner discharging a substantially equal number of positive and negative ions to travel at a selected velocity differential therebetween to selectively modulate the neutralization of ions in transit.

13 Claims, 6 Drawing Figures

STATIC CHARGE NEUTRALIZING SYSTEM AND METHOD

This invention pertains to a system and method for neutralizing a static charge on a work surface such as a table top, and more particularly to such a system and method for rapidly reducing the static charge by alternately activating positive and negative ion discharge devices at a rate responsive to the degree of static charge.

Heretofore, ion discharge systems have been provided for use in so-called "clean rooms". Ion discharge elements typically are installed to protrude downwardly from the ceiling of such rooms.

One limitation experienced with systems of the prior art has been found in the fact that they neutralize the static charge at the work surface rather slowly.

Other systems consume substantial power to provide sufficient ions to neutralize the static charge at the location of the work surface.

It is an object of this invention to provide an improved system and method for neutralizing a static charge on a work surface.

It is another object of the invention to provide an ion discharge system and method for quickly neutralizing the static charge and for maintaining the static charge neutralized with substantial stability and with limited voltage variation with respect to zero.

Yet another object of the invention is to provide a static charge neutralizing system and method wherein positive and negative ion discharge devices are operated alternately at a rate inversely responsive to the degree of static charge on the work surface.

A further object of the invention is to provide such an ion discharge system for supplying positive and negative ions to the work surface in substantially equal amounts.

An additional object of the invention is to supply positive and negative ions in alternate layers in a manner readily controlling the voltage level at the surface to be neutralized.

Another object of the invention is to propagate positive and negative ions toward a work surface at selected velocities to control the degree of ion neutralization during transit to the work surface.

The foregoing and other objects of the invention will become more readily evident from the following detailed description of a preferred embodiment when considered in conjunction with the drawings.

In general, a system for neutralizing a static charge on a work surface employs a negative and positive ion discharge means, and a negative and positive power supply respectively coupled to the negative and positive ion discharge means for operating same. Control means serve to alternately operate the negative and positive ion discharge means in response to the static voltage detected at the work surface. The control means switches between operation of the negative and positive ion discharge means substantially at a rate inversely proportional to the static voltage detected.

DETAILED DESCRIPTION OF PREFERRED EMBODIMENT

Figure 1:
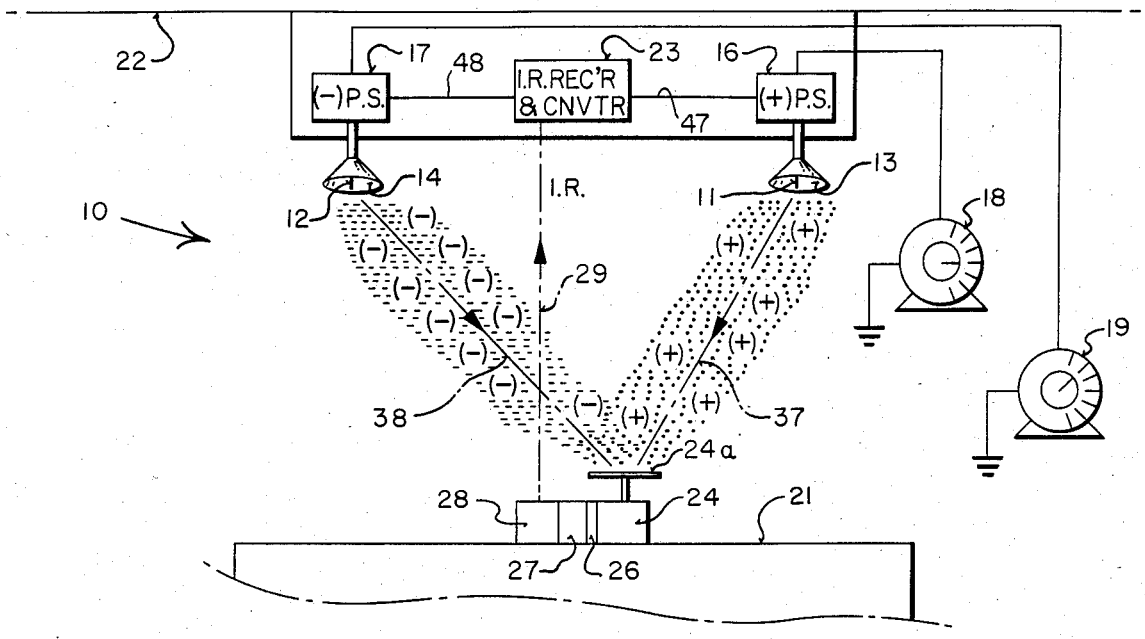
FIG. 1 shows a diagrammatic view of a static charge neutralizing system according to the invention.

It will be readily evident that the presence of unequal numbers of positive and negative ions at a work surface will provide an undesirable positive or negative static charge which, for many applications, will need to be neutralized. An important objective as disclosed further below is to successively provide substantially equal numbers of positive and negative ions at the work surface whereby each successive layer of ions will immediately neutralize the preceding layer of ions.

While the foregoing objective would appear to be relatively uncomplicated, it becomes additionally involved when it is observed that the negative ions are generated at lower voltages than the positive ions. Accordingly, it would appear to be relatively simple to adjust the voltages supplied to the negative and positive ion discharge means. However, it has been discovered that this creates an additional problem, namely the fact that the negative ions travel faster than the positive ions. Accordingly, as the two groups of positive and negative ions are travelling toward the work surface, the negative ions will pass through layers of positive ions and neutralize them in transit on their way to the work surface.

Accordingly, as disclosed in greater detail further below, a system has been provided for neutralizing a static charge on a work surface employing positive and negative ion discharge means with associated positive and negative power supplies coupled thereto. Means for setting the voltages of the positive and negative power supplies with respect to each other serves to provide a selected ion velocity differential (including equal velocities) between the velocity of the positive and negative ions. Means for sensing the static voltage at the work surface serves to operate a suitable controller which is arranged to be responsive to the static voltage for alternately operating the positive and negative ion discharge means in a manner discharging a substantially equal number of positive and negative ions. The control means alternately operates the positive and negative ion discharge means at a rate substantially inversely proportional to the static voltage at the work surface.

By alternately discharging positive and negative ions at a rate substantially inversely proportional to the static voltage sensed, the static voltage can be rapidly reduced to zero while maintaining the neutralized charge with minimal variation (voltage modulation) across the zero voltage axis.

A static charge neutralizing system 10 of a type suitable for use in a "clean room" includes a positive ion discharge element 11 and a negative ion discharge element 12. Ion discharge elements 11, 12 are of known design and are of a needle-like construction. Each of the ion discharge elements 11, 12 is disposed in a protective, conically shaped plastic shield 13, 14.

Elements 11, 12 are respectively coupled to a positive DC power supply 16 and a negative DC power supply 17.

Means for controlling the voltage of each of the power supplies 16, 17 includes a pair of potentiometers 18, 19 coupled respectively to power supplies 16, 17 for purposes described further below.

As shown in FIG. 1, a work surface 21 of a table is disposed in a "clean room" represented by the ceiling 22.

Suitable control means 23 alternately operates one or the other of the two power supplies 16, 17 and switches from one to the other at a rate of alternation inversely responsive to the amount of the static charge at surface 21. Accordingly, a static voltage detector 24, having a broad metal charge plate **24*a* for receiving ions, converts the charge voltage to a positive or negative voltage dependent upon whether plate 24*a* is positive or negative. Thus, a static voltage detector 24 provides an analog output signal representative of the level of static voltage at surface 21. This output supplies an input to an analog to digital converter 26. A microprocessor 27 converts the absolute value of the static voltage to a signal inversely proportional to the static voltage for establishing the relative duty cycle between the two power supplies 16, 17** now to be described.

Microprocessor 27 generates a suitable coded instruction to be received by an infrared transmitter 28. For example, one suitable coded instruction can include a ten bit word wherein: the first four bits define the pulse period, i.e., the duration of operation of each power supply; the next four bits define the pulse rate; and finally, a ninth bit provides a parity bit while a tenth bit acts as a stop bit.

Transmitter 28 serves to transmit a beam 29 of such coded instructions to a receiver portion of control means 23.

The signals transmitted via beam 29 cause controller 23 to alternately operate power supplies 16, 17 substantially at a rate inversely proportional to the static voltage detected. By so controlling the relationship of the duty cycle of each of the two power supplies 16, 17 it is possible to quickly reduce the static charge at surface 21.

Figure 4:
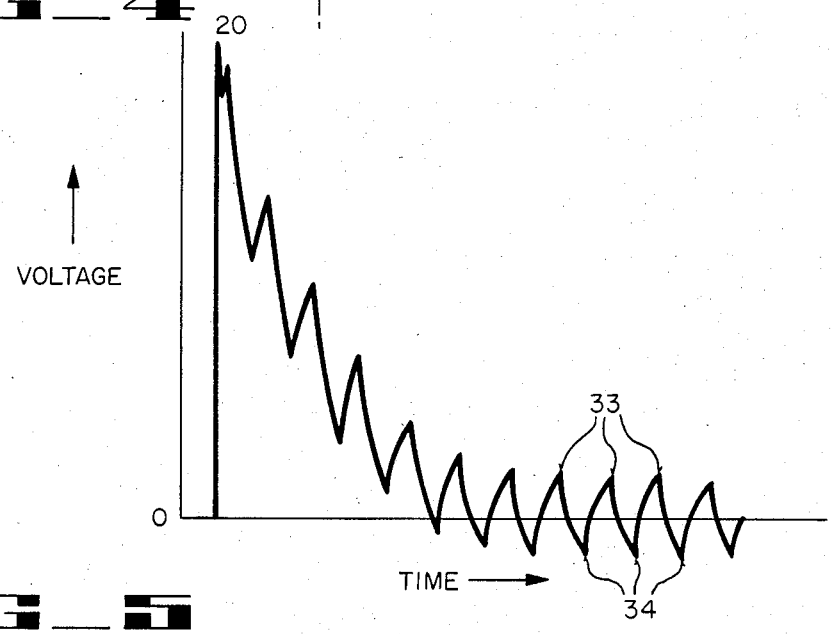
FIG. 4 shows a graph illustrative of the rate of reduction of the static voltage as the positive and negative ion discharge means are alternately energized at a relatively slow rate.

Thus, as shown in FIG. 4 assuming an initial static voltage at point 20 to be positive, a relatively rapid reduction in static voltage is achieved by alternately operating the positive and negative ion discharge devices 11, 12 at a relatively low "frequency" (i.e., rate of switching from one power supply 16, 17 to the other).

A substantially equal number of positive and negative ions must be generated to provide a uniform variation across the zero axis. Accordingly, as disclosed herein and as represented by the wave form in FIG. 2, control means 23 serves to operate the positive ion discharge means 11 sufficiently longer than the negative ion discharge means 12 so as to discharge a substantially equal number of positive and negative ions. Thus in the wave form of FIG. 2 the envelope 31 represents the period of operation of power supply 16 while envelope 32 represents the period of operation of power supply 17.

Controller 23 includes an infrared receiver/converter 41 of a type for receiving the infrared coded instruction signals via path or beam 29 and converting this input to a suitable logic voltage level. Thus, a control instruction appears on output lead 42. This control instruction corresponds to the control instruction transmitted via path 29 and can comprise the same ten bit word. Converter 41 supplies these control instructions to an asynchronous communication interface adapter 43 (ACIA) of known design which converts the serial data of each instruction to provide, for example, a pair of four bit words in parallel as the output. The ACIA 43 further removes the ninth and tenth bits from the ten bit instruction previously received.

Accordingly, the first four bit word can be applied to the output lead 44 to set a predetermined count into an up/down counter 46. Using a four bit code, counter 46 can only count to "16". Counter 46 of a known type such as a programmable counter can be arranged to count up to the predetermined number instructed by the first four bit word arriving via lead 44 and then count down by the complement of the predetermined count, and then reset to zero. Thus, if the predetermined count instructed by the first word is a count of "11" then counter 46 will first count up to "11" and then count "5" down from that number (i.e., the complement of "16".

During the "up" counting, one power supply (preferably the positive power supply) will be activated via a signal on lead 47 whereas during the down counting the other, or negative, power supply will be activated via lead 48.

The rate at which counter 46 advances from one count to the next is controlled by the second four bit word as now to be described.

A suitable oscillator 51 supplies a substantially uniform pulse train via lead 52 to one input of a divider 49 of known type wherein the rate of output pulses can be controlled by selectively entering various divisors, N. Thus, the second four bit word defines N as the second input to divider 49 via lead 53. Assuming that oscillator 51 generates 60 cycles per second and that the second four bit word supplied via lead 53 provides a divisor, N, of "ten", the output on lead 54 supplies a pulse rate of six pulses per second to counter 46.

Accordingly, the rate at which counter 46 is supplied with pulses to be counted will be controlled by the second four bit word of the coded instruction.

In addition, the ratio of time that the positive power supply will be activated to the time that the negative power is activated is controlled by the first four bit word serving to operate the up/down counter in the manner described above. By using a programmable counter, i.e., one which will count up for the number of bits instructed by a first word and then down by the complement of the up count with respect to the maximum count in the counter, the amount of positive and negative ions can readily be controlled.

Figure 5:
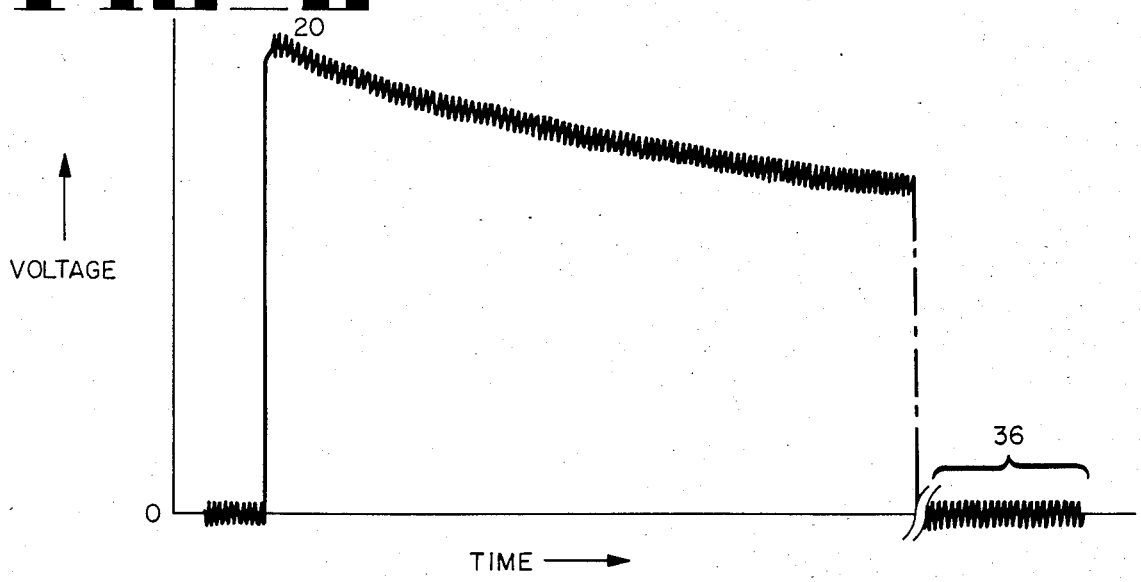
FIG. 5 shows a graph representing the rate of reduction in static voltage as the positive and negative ion discharge means are alternately energized at a relatively high rate.

By comparison to the rapid rate at which the static voltage can be reduced to zero as shown in FIG. 4, by reference to FIG. 5 it will be readily evident that should the positive and negative ion discharge means be operated alternately at a relatively high rate of alternation or frequency, the static voltage will be only gradually reduced over a relatively longer period of time. Thus the graph shown in FIG. 5 represents a plot of static voltage against time at a significantly greater rate of power supply alternation than that shown in FIG. 4.

A system operating according to the relatively low rate of power supply alternation shown in FIG. 4 has the disadvantage that the voltage modulation across the zero axis will have a relatively wide positive and negative swing as indicated for example by the peaks 33, 34 respectively. However, the static charge at the table top or work surface can be maintained neutralized with a minimal variation or voltage modulation by using the high rate of alternation shown in FIG. 5 thereby providing a relatively stabilized charge at the work surface. Note, for example, the region identified as 36.

By operating power supplies 16, 17 and hence ion discharge elements 11, 12 alternately for the proportionate periods of time shown in wave form 30 so as to propagate equal positive and negative ions, a relatively rapid reduction in the static voltage at surface 21 can be achieved by switching between the two power supplies 16, 17 at a rate inversely proportional to the static voltage detected by static voltage detector 24. Accordingly, as the value of the voltage on surface 21 becomes less and less, the rate of switching between power supplies 16, 17 will be progressively increased and achieve the stability shown in FIG. 5 at 36.

While the foregoing arrangement serves to provide equal numbers of positive and negative ions to be supplied to neutralize a static voltage on surface 21, it has been discovered that negative ions travel much faster than the positive ions and therefore pass through the layers of positive ions so as to neutralize both.

Figure 3:
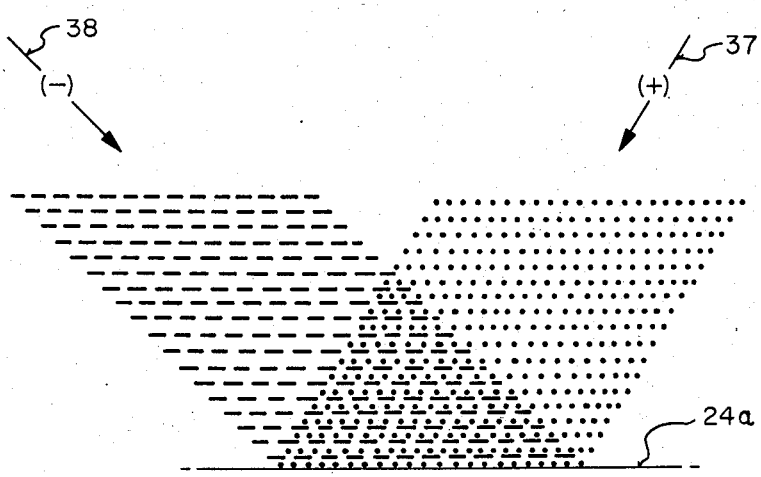
FIG. 3 shows a diagram of positive and negative ions alternately reaching a support surface having a charge to be neutralized.
Figure 6:
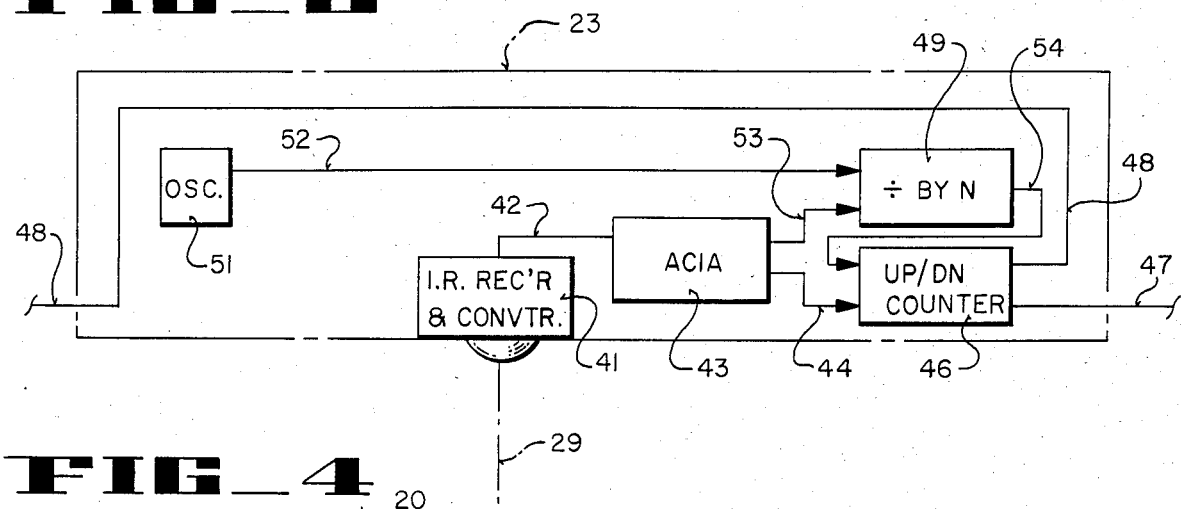
FIG. 6 shows a diagrammatic view of a controller for alternately operating power supplies, according to the invention.

Accordingly, it is desired to provide interleaved layers of positive and negative ions whereby successive layers of ions arriving at surface 21 will be successively positive and negative. In FIG. 3 layers of positive ions travelling in the direction of arrow 37 have been shown interleaved with negative ions travelling in the direction of arrow 38. As disclosed further below, by adjusting the relative voltage between the positive and negative power supplies 16, 17 they can propagate positive and negative ions at substantially the same velocity so as to establish a substantially interleaved relationship between the positive and negative ion layers as shown in FIG. 3. Further, in order to control the degree of ion neutralization while the ions are in transit between needles 11, 12 and work surface 21, means have also been provided for varying the ratio of voltages between the positive and negative power supplies to impart a selected relative velocity differential between the velocity of the positive and negative ions. In this way some selected neutralization of ions can be provided, as desired.

Accordingly, the voltage of the positive power supply substantially equals the voltage of the negative power supply multiplied by the ratio of $k+/k-$ where $K+$ and $k-$ are respectively the ion mobility factors for positive and negative ions in gas (such as air or otherwise) disposed between the positive and negative ion discharge means 11, 12 and the work surface 21. As shown in FIG. 1 potentiometers 18, 19 are provided for respectively varying the voltage at power supplies 16, 17 respectively.

It has been observed that the ion mobility factor for negative ions in air can be represented by the factor 2.10 while the positive ion mobility factor in air may be represented by the factor 1.36. Accordingly, the voltage of the negative power supply will substantially equal the voltage of the positive power supply multiplied by the ratio of $k+/k-$, i.e., $V_{30}=V_{-}\times 2.10/1.36$ in order to provide equal velocities to the ions emanating from needles 11, 12, i.e., a zero velocity differential.

Figure 2:
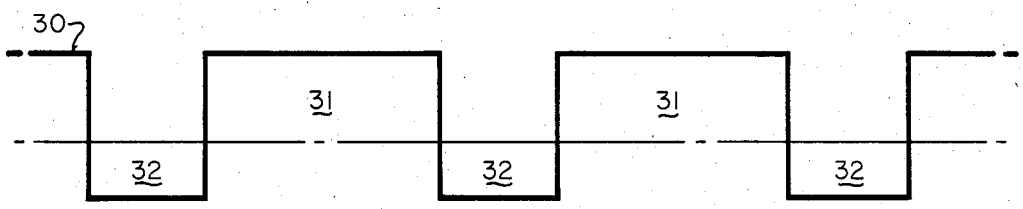
FIG. 2 shows a diagrammatic square wave for purposes of explanation.

Accordingly, as shown in FIG. 2 and as represented by the above equation, the positive voltage represented by the envelopes 31 in wave form 30 are approximately 1.5 times the voltage for the negative portions 32 of wave form 30 with respect to the zero axis.

Preferably, it will be desirable to establish the positive voltage initially and multiply it by the fraction 1.36/2.10 to determine the negative voltage in order to provide equal velocity delivery of the ions to work surface 21.

From the foregoing it will be readily evident that there has been provided an improved means for quickly reducing the static voltage level at a work surface in a manner whereby the frequency of switching between positive and negative power supplies will increase as the static voltage is reduced thereby maintaining a stable static voltage of substantially zero volts at work surface 21. In addition, means are provided for propagating the positive and negative ions at selected velocities to control the degree of ion neutralization while the ions are in transit.

I claim:

1. A system for neutralizing a static charge on a work surface comprising negative ion discharge means, positive ion discharge means, negative and positive power supplies respectively coupled to said negative and positive ion discharge means, control means for alternately operating said negative and positive ion discharge means, means for detecting the static voltage at said surface, and means responsive to said detected voltage for operating said control means to switch between operation of said negative and positive ion discharge means substantially at a rate inversely proportional to the static voltage detected.

2. A system according to claim 1 in which said control means operates said positive and negative ion discharge means in a manner serving alternately to discharge a substantially equal number of positive and negative ions.

3. A system according to claim 2 in which said control means operates said positive ion discharge means sufficiently longer than said negative ion discharge means so as to discharge a substantially equal number of positive and negative ions.

4. A system according to claim 1 in which said positive and negative power supplies have voltages serving to propagate positive and negative ions at substantially the same velocity.

5. A system for neutralizing a static charge on a work surface comprising positive and negative ion discharge means, positive and negative power supplies respectively providing positive and negative voltage to said positive and negative ion discharge means, means for alternately operating said positive and negative power supplies, means coupled to said power supplies for selectively varying the ratio of voltages between the positive and negative power supplies to impart a selected relative velocity differential between the velocity of the positive and negative ions to selectively control the degree of ion neutralization while said ions are in transit to said work surface.

6. A system for neutralizing a static charge on a work surface comprising positive and negative ion discharge means, positive and negative power supplies respectively supplying positive and negative voltage respectively to said positive and negative ion discharge means, control means for alternately operating said positive and negative ion discharge means, operation of one of said ion discharge means being followed directly by operation of the other, means for varying the ratio of said voltages of said positive and negative power supplies to impart a selected relative velocity differential between the velocity of said positive and negative ions to control the degree of ion neutralization during transit of ions from the associated discharge means to said work surface.

7. A system for neutralizing a static charge on a work surface comprising positive and negative ion discharge means, positive and negative power supplies respectively coupled to said positive and negative ion discharge means, control means for alternately operating said positive and negative ion discharge means, means for varying the ratio of voltages between said positive and negative power supplies to impart a selected relative velocity differential between the velocity of said positive and negative ions to control the degree of ion neutralization during transit of ions from the associated discharge means to said work surface, the voltage of said negative power supply being substantially equal to the product of the voltage of said positive power supply multiplied by the ratio of $k+/k-$ where $k+$ and $k-$ are respectively the ion mobility factors for positive and negative ions in gas disposed between said positive and negative ion discharge means and said work surface.

8. A system for neutralizing a static charge on a work surface comprising positive and negative ion discharge means, positive and negative power supplies respectively coupled to said positive and negative ion discharge means, means for setting the voltages of said positive and negative power supplies with respect to each other to provide a selected ion velocity differential between the velocity of the positive and negative ions, means for sensing the static voltage at the work surface, control means responsive to the last named means for alternately operating said positive and negative ion discharge means in a manner serving to alternately discharge a substantially equal number of positive and negative ions and alternately operating said positive and negative ion discharge means at a rate substantially inversely proportional to the static voltage sensed.

9. The method of neutralizing a static charge on a work surface comprising the steps of alternately propagating positive ions for a first predetermined time period, propagating negative ions for a second predetermined time period, sensing the static voltage at said work surface, and reducing said voltage at said work surface by switching between said propagation of positive and negative ions at a rate substantially inversely proportional to the static voltage at said work surface.

10. The method according to claim 9 wherein said first and second predetermined time periods serve to supply substantially equal numbers of positive and negative ions.

11. The method of neutralizing a static charge on a work surface comprising the steps of alternately propagating positive and negative ions toward said work surface, modulating the velocity of ions of one sign with respect to that of an opposite sign to impart a selected relative velocity differential between the velocity of said positive and negative ions to control the degree of ion neutralization occurring while both said positive and negative ions are jointly in transit to the work surface.

12. The method of controlling the degree of ion neutralization in a field of gas disposed between positive and negative ion discharge means and a work surface having a static charge to be neutralized, the method comprising the steps of alternately applying positive and negative voltages to the positive and negative ion discharge means in a manner serving to propagate substantially equal amounts of positive and negative ions toward the work surface, and varying the ratio of positive to negative voltages to impart a selected velocity differential between the velocity of the positive and negative ions.

13. The method of controlling the degree of ion neutralization in a field of gas disposed between positive and negative ion discharge means and a work surface having a static charge to be neutralized, the method comprising the steps of alternately applying positive and negative voltages to the positive and negative ion discharge means to propagate substantially equal amounts of positive and negative ions toward the work surface, varying the ratio of positive to negative voltages to impart a selected velocity differential between the velocity of the positive and negative ions, the last named step varying the ratio of positive to negative voltages in a manner establishing the negative voltage as equal to the product of the positive voltage multiplied by the ratio of $k+/k-$ where $k+$ and $k-$ are respectively the ion mobility factors for positive and negative ions in gas disposed between said positive and negative ion discharge means and said work surface.

* * * * *